US008726766B1

(12) United States Patent
Wu

(10) Patent No.: US 8,726,766 B1
(45) Date of Patent: May 20, 2014

(54) ONE-WAY TORQUE TOOL

(71) Applicant: Yi Min Wu, Taichung (TW)

(72) Inventor: Yi Min Wu, Taichung (TW)

(73) Assignee: Matatakitoyo Tool Co., Ltd., Taichung (TW)

( * ) Notice: Subject to any disclaimer, the term of this patent is extended or adjusted under 35 U.S.C. 154(b) by 0 days.

(21) Appl. No.: 13/691,477

(22) Filed: Nov. 30, 2012

(51) Int. Cl.
*B25B 13/46* (2006.01)

(52) U.S. Cl.
USPC ..... 81/62; 81/60

(58) Field of Classification Search
USPC ..... 81/62, 60, 124.2, 121.1
See application file for complete search history.

(56) References Cited

U.S. PATENT DOCUMENTS

| | | | | |
|---|---|---|---|---|
| 6,862,955 | B1 * | 3/2005 | Shu-Sui et al. | 81/60 |
| 6,981,434 | B2 * | 1/2006 | Chen | 81/63.1 |
| 6,988,429 | B2 * | 1/2006 | Lee et al. | 81/63.2 |
| 2003/0136232 | A1 * | 7/2003 | Chang | 81/60 |
| 2006/0027049 | A1 * | 2/2006 | Arnold | 81/60 |
| 2011/0100165 | A1 * | 5/2011 | Lee et al. | 81/60 |

* cited by examiner

*Primary Examiner* — Monica Carter
*Assistant Examiner* — Danny Hong

(57) ABSTRACT

A one-way torque tool includes a head, a rotor placed in the head, a number of ratchets formed on the head, two pawls pivotally connected to the rotor and detachably engaged with the ratchets. The ratchets are separated from one another by a first angle α identical to 360 degrees divided by the number of the ratchets. The pawls are separated from each other by a second angle β identical to a multiple of the first angle α plus a third angle θ that is smaller than the first angle α.

20 Claims, 9 Drawing Sheets

ONE-WAY TORQUE TOOL

BACKGROUND OF INVENTION

1. Field of Invention

The present invention relates to a one-way torque tool and, more particularly, to a one-way torque tool that requires a small angle of neutral rotation before active rotation can be executed again.

2. Related Prior Art

A conventional torque tool is often used to drive a nut or screw. For example, a wrench may be used to drive a nut or screw. A screwdriver may be used to drive a screw. An Allen key may be used to drive a screw.

A one-way torque tool is often used to drive a nut or screw in a limited space. A one-way torque tool may be a one-way (or "ratchet") wrench or screwdriver. For example, a one-way wrench includes a handle extending from a hollow head, a rotor rotationally placed in the head, and a one-way driving unit or transmission arranged between the head and the rotor. A one-way screwdriver includes a handle, a rotor rotationally placed in the handle, and a one-way driving unit or transmission arranged between the handle and the rotor. The one-way transmission generally includes a pawl pivotally connected to the head or handle and a toothed wheel co-axially connected to the rotor. In operation, then rotor is engaged with a nut or screw via a socket for example, and the handle is rotated to and fro. The rotor is driven by the handle via the one-way transmission as the pawl is engaged with the toothed wheel when the handle is rotated in an active direction. The rotor is not driven by the handle via the one-way transmission as the pawl is disengaged from the toothed wheel when the handle is rotated in a neutral direction.

As disclosed in U.S. Pat. No. 6,655,238, a ratchet tool includes a head 30, an engaging ring 40, a pawl 50 and a spring 34. The engaging ring 40, the pawl 50 and the spring 34 are placed in the head 30. Biased by the spring 34, teeth of the pawl 50 are engaged with teeth of the engaging ring 40.

As disclosed in U.S. Pat. No. 4,147,076, a reversing-ratchet wrench includes a lever 10 formed with a fulcrum end 12, a pawl carrier 20 placed in the fulcrum end 12, a double pawl element 27 supported on the pawl carrier 20, and a ratchet drive selector mechanism 30 connected to the double pawl element 27. The ratchet drive selector mechanism 30 is used to bring teeth formed on a selected one of two ends of the double pawl element 27 with teeth formed on an internal side of the fulcrum end 12. Thus, the reversing-ratchet wrench is switched between a tightening mode and a loosening mode. A similar wrench can be found in U.S. Pat. No. 4,261,233.

U.S. Pat. No. 5,074,174 discloses a socket wrench including a body 1, a ratchet member 108 and a plurality of socket members 102, 103 and 104. The ratchet member 108 and the socket members 102, 103 and 104 are placed in the body 1. The ratchet member 108 includes two pawls 180 and 181 and a cam 182. By operating the cam 182, teeth of a selected one of the pawls 180 and 181 is engaged with teeth of the socket member 104.

It should be noted that after the handle is rotated in the active direction to drive the nut or screw, the handle must be rotated in the neutral direction for the angle of at least one tooth to return the pawl into engagement with the toothed wheel before the handle can be rotated in the active direction to drive the nut or screw again. For example, if the toothed wheel includes twenty-four teeth, i.e., the angle of each tooth is 15°, the handle must be rotated in the neutral direction for at least 15° before the handle can be rotated in the active direction to drive the nut or screw again. There is however not enough space for the rotation of the handle in the neutral direction for the angle of one tooth.

The number of the teeth can be increased to reduce the angle of a tooth. As disclosed in U.S. Pat. No. 6,666,111 for example, the number of the teeth is 90 to 180 so that the angle of one tooth is 4° to 2°. As the number of teeth is large, the size of the teeth is small, and the strength of the teeth is low. The teeth could easily be worn away.

Furthermore, for each of the conventional torque tools, the number of the teeth is constant, i.e., the angle of one tooth is constant. A user may not be able to exert large torque if he or she chooses to use a toque tool with a large number of teeth such as disclosed in U.S. Pat. No. 6,666,111 in limited space. Hence, there is an unsatisfied need for a torque tool to allow a user to exert large torque in limited space. The present invention is therefore intended to obviate or at least alleviate the problems encountered in prior art.

SUMMARY OF INVENTION

It is the primary objective of the present invention to provide a torque tool to allow a user to exert large torque in limited space. To achieve the foregoing objective, the one-way torque tool includes a head, a rotor placed in the head, a number of ratchets formed on the head, two pawls pivotally connected to the rotor and detachably engaged with the ratchets. The ratchets are separated from one another by a first angle $\alpha$ identical to 360 degrees divided by the number of the ratchets. The pawls are separated from each other by a second angle $\beta$ identical to a multiple of the first angle $\alpha$ plus a third angle $\theta$ that is smaller than the first angle $\alpha$.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF PREFERRED EMBODIMENT

Figure 1:
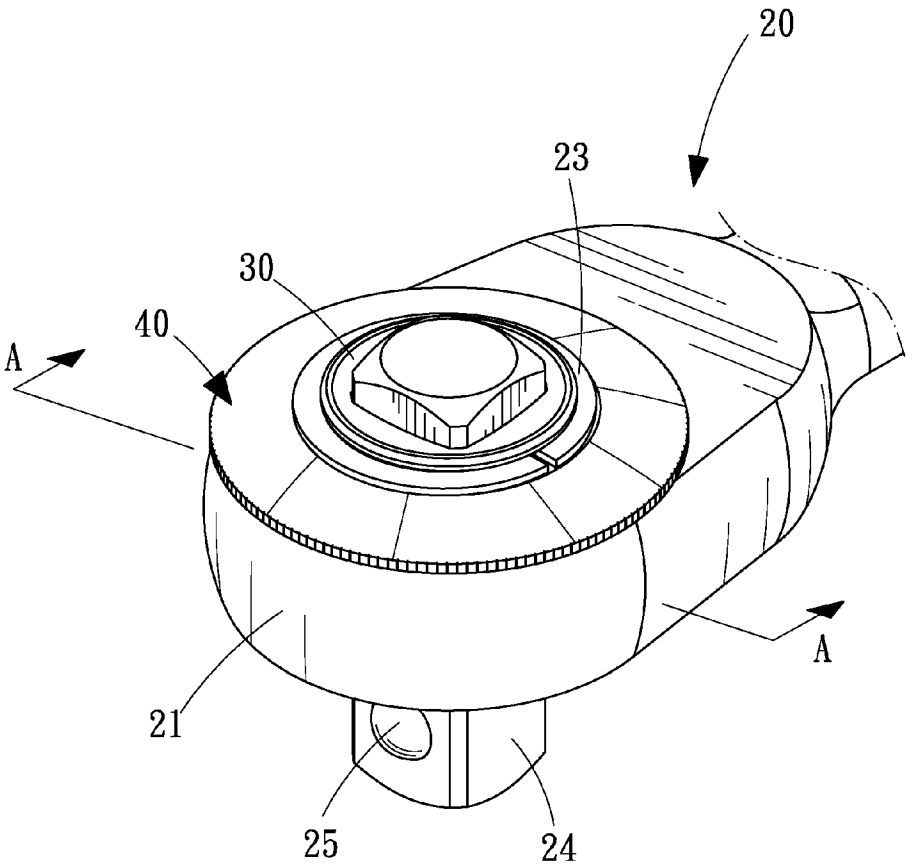
FIG. 1 is a perspective view of a one-way torque tool according to the first embodiment of the present invention.
Figure 2:
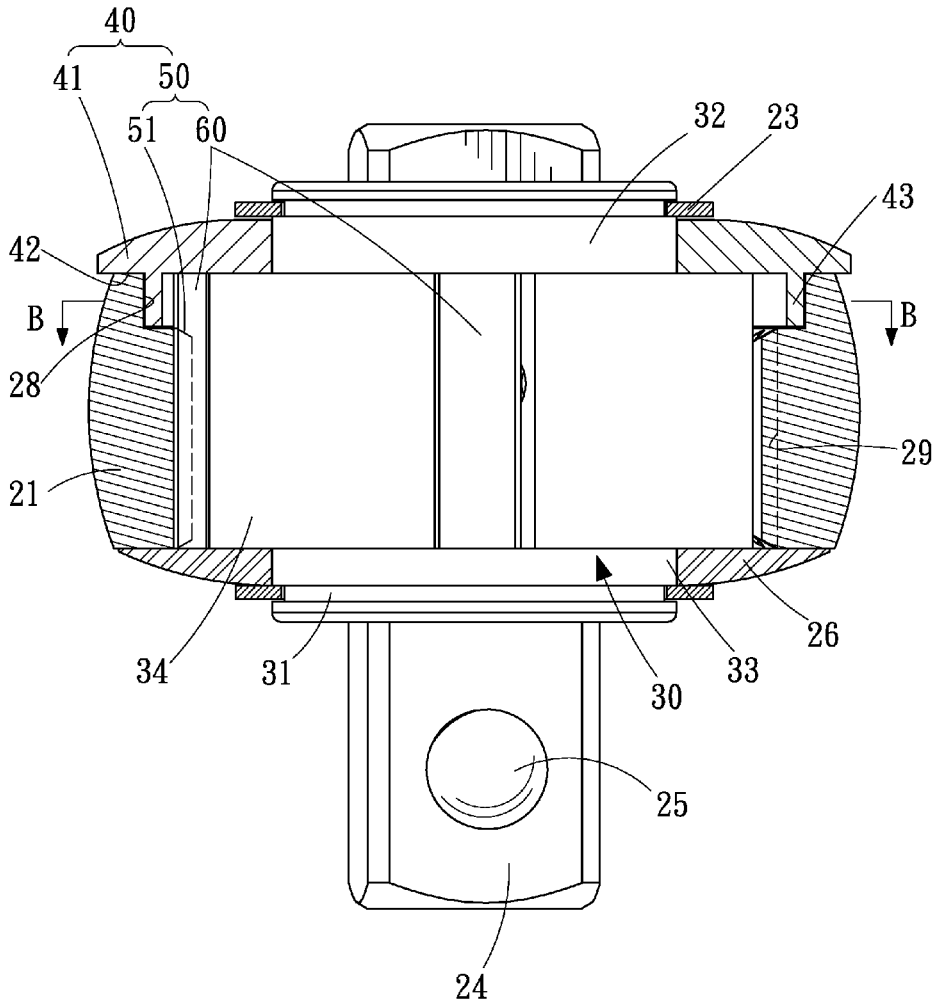
FIG. 2 is a cross-sectional view of the one-way torque tool taken along a line A-A shown in FIG. 1.

Referring to FIGS. 1 through 8, there is shown a one-way torque tool in the form of a wrench 20 according to a first embodiment of the present invention. Referring to FIGS. 1 and 2, the wrench 20 includes a head 21, a rotor 30 rotationally placed in the head 21, a switch 40 and a one-way transmission 50. In short, the one-way transmission 50 is arranged between the head 21 and the rotor 30. The head 21 can be rotated in an active direction to drive the rotor 30 via the one-way transmission 50. The head 21 can be rotated in a neutral direction opposite to the active direction without driving the rotor 30 via the one-way transmission 50. The switch 40 is operable to change a minimum angle of the rotation of the head 21 in the neutral direction before the head 21 can be rotated in the active direction to drive the rotor 30 via the one-way transmission 50 again.

The head 21 includes an upper space 28 axially defined therein and a lower space 29 axially defined therein. The upper space 28 is made with a diameter larger than that of the lower space 29.

The rotor 30 includes an upper section 32, a lower section 33 and a middle section 34 extending between the upper section 32 and the lower section 33. The upper section 32 is made with a diameter substantially identical to that of the lower section 33. The diameter of the upper section 32 is smaller than that of the middle section 34. A groove 31 is defined in the periphery of each of the upper and lower sections 32 and 33.

Figure 3:
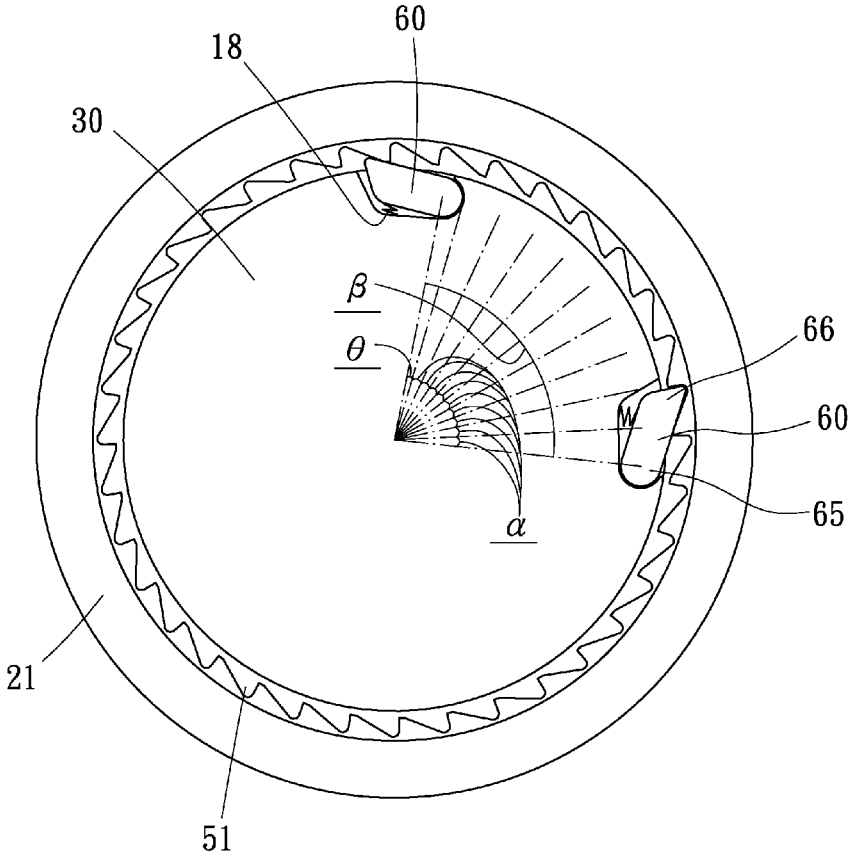
FIG. 3 is a top view of a one-way transmission used in the one-way torque tool shown in FIG. 1.

Referring to FIG. 3, the one-way transmission 50 preferably includes thirty-six ratchets 51 for engagement with two pawls 60 for example. The one-way transmission 50 may include another proper number of ratchets 51 and another proper number of pawls 60. The ratchets 51 are formed on the wall of the lower space 29 of the head 21. The angle $\alpha$ of each of the ratchets 51 is 10°. The pawls 60 are pivotally connected to the middle section 34 of the rotor 30. The pawls 60 are separated from each by an angle $\beta$ of 85° for example. The angle between the pawls 60 is derived from the angle of each of the ratchets 51 according to the following notion:

$$\beta=n\cdot\alpha+\theta \quad (1)$$

wherein n is an integer smaller than half of the number of the ratchets 51, and $\theta$ is an angle smaller than $\alpha$. In the preferred embodiment, the number of the ratchets 51 is 36, n is 8, and $\theta$ is 5°.

Figure 4:
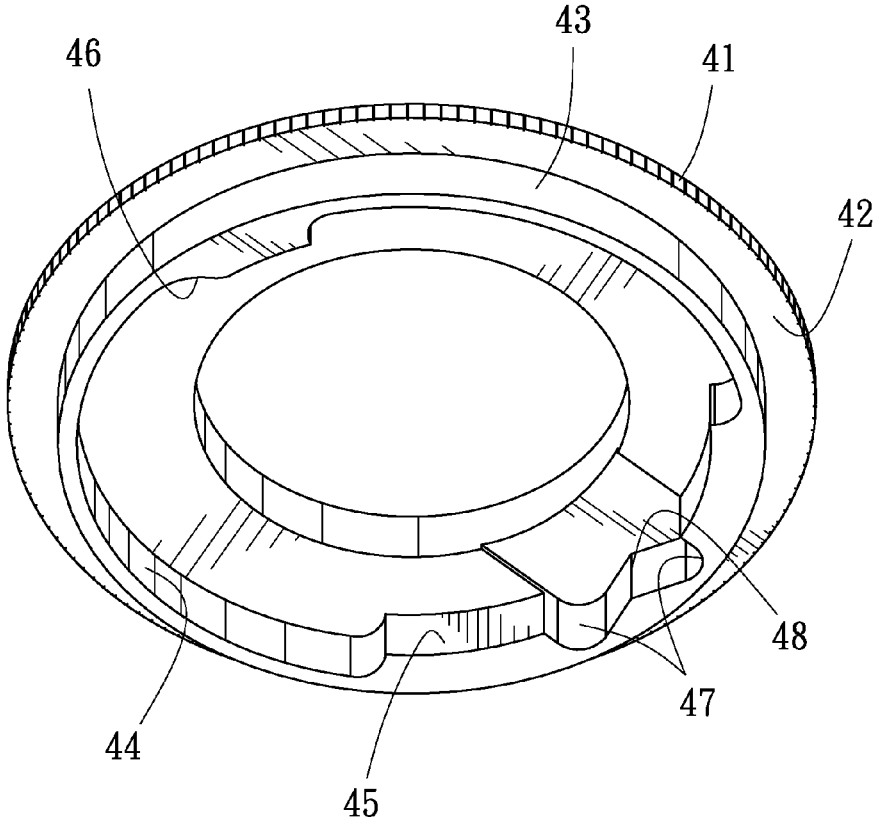
FIG. 4 is a perspective view of an upper ring used in the one-way transmission shown in FIG. 3.

Referring to FIG. 4, the upper ring 41 includes a rib 43 extending on a lower face 42 which is in contact with the head 21. The rib 43 includes two thin portions 44 and two thick portions 45. The thin portions 44 and the thick portions 45 are alternately arranged along the rib 43. One thick portion 45 (the "long thick portion 45) extends longer than the other thick portion 45 (the "short thick portion 45). An internal diameter of the thin portions 44 is larger than that of the thick portions 45. There is a transient portion 46 formed between the short thick portion 45 and the adjacent thin portion 44. The long thick portion 45 includes two recesses 47 defined in an internal side. The recesses 47 are separated from each other by a peak 48 which does not extend beyond the long thick portion 45.

Figure 5:
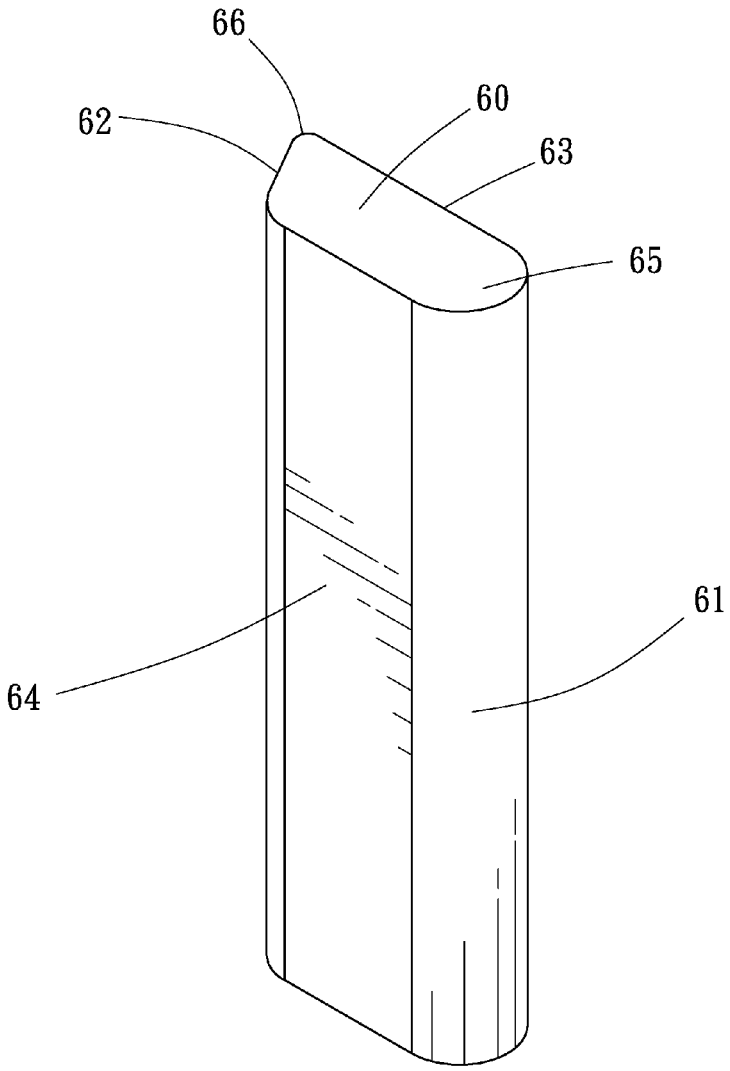
FIG. 5 is a perspective view of a pawl used in the one-way transmission shown in FIG. 3.

Referring to FIG. 5, description will be given to only one of the pawls 60 since the pawls 60 are identical. The pawl 60 includes an arched face 61, an inclined face 62, a long side 63, a short side 64, a pivot 65 and a tip 66. The arched face 61 is placed opposite to the inclined face 62. The long side 63 is placed opposite to the short side 64. The pivot 65 is placed near the arched face 61. The tip 66 is formed by and between the inclined face 62 and the long side 63.

Figure 6:
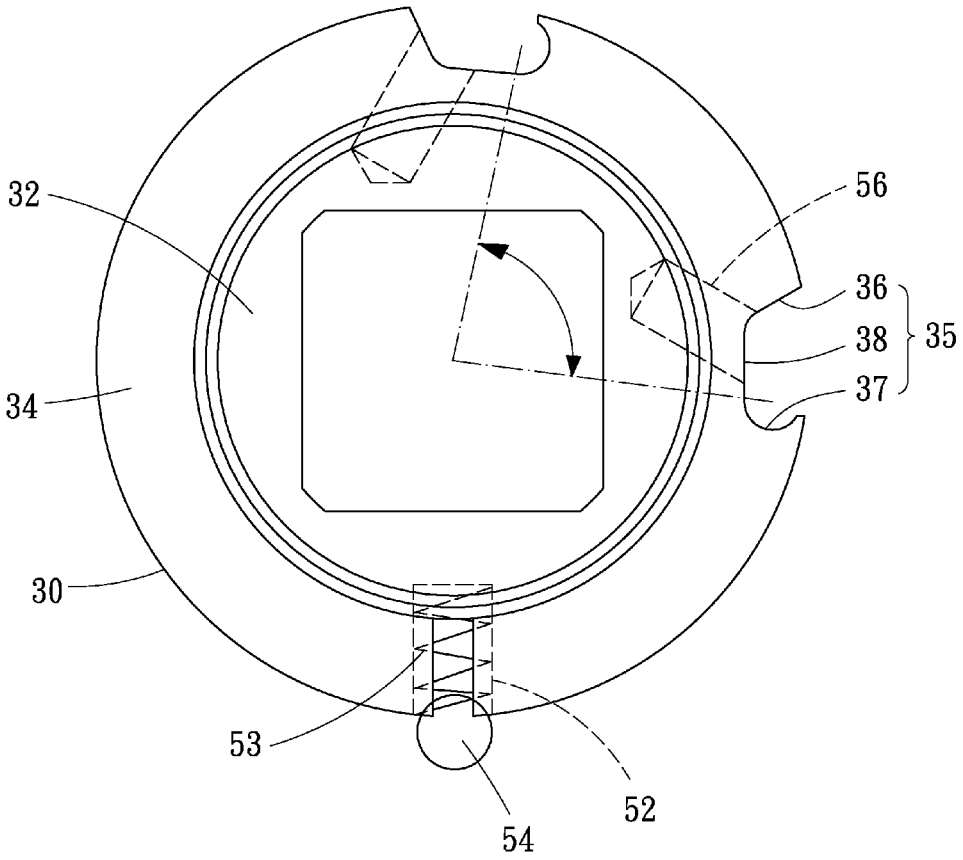
FIG. 6 is a top view of a rotor used in the one-way transmission shown in FIG. 3.

Referring to FIG. 6, the rotor 30 includes two cutouts 35, two pockets 56 and a bore 52 defined in the middle section 34. The cutouts 35 are defined in the periphery of the middle section 34 of the rotor 30. The shape of the cutouts 35 is in compliance with that of the pawls 60. Each of the cutouts 35 includes an inclined face 36, an arched face 37 and a flat side 38 extending between the inclined face 36 and the arched face 37. A center of the arched face 37 of the first cutout 35 is separated from that of the second cutout 35 by the angle $\beta$. Each of the pockets 56 is in communication with a corresponding one of the cutouts 35. An axis of each of the pockets 56 does not extend to the center of the arched face 37 of the corresponding one of the cutouts 35.

Figure 7:
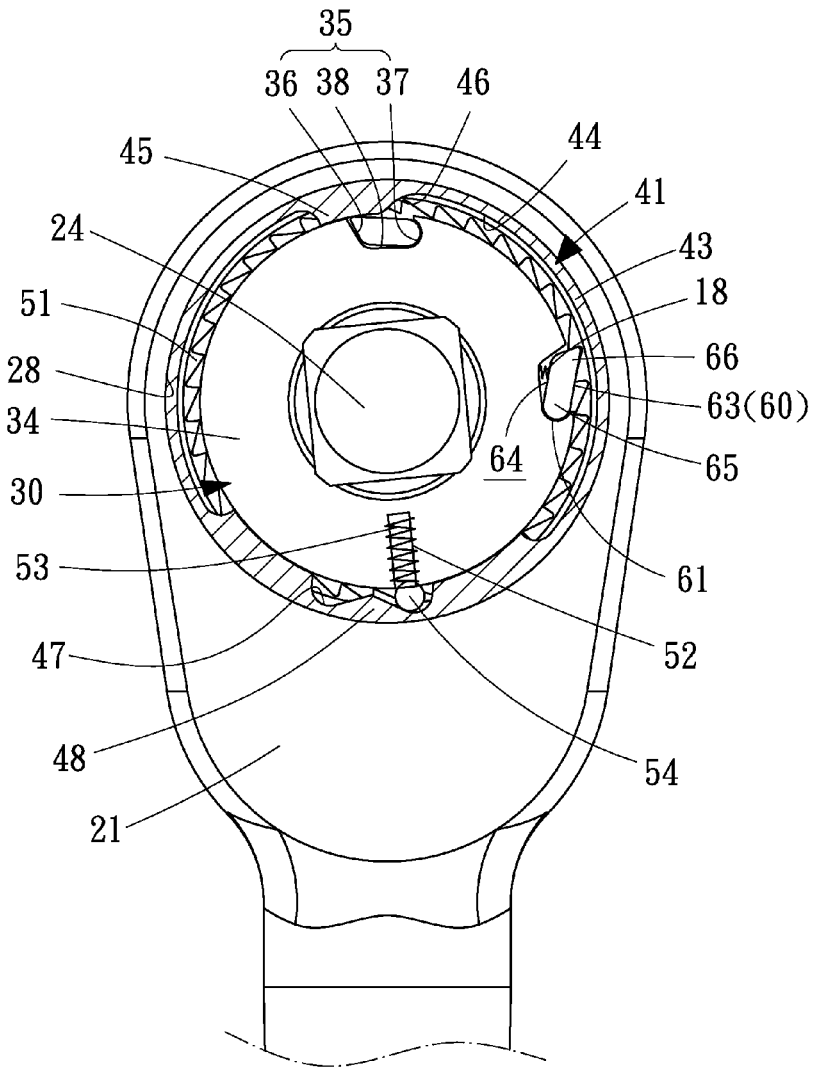
FIG. 7 is a cross-sectional view of the one-way torque tool taken along a line B-B shown in FIG. 2.

Referring to FIG. 7, a spring 18 is placed in each of the pockets 56. The pawls 60 are placed in the cutouts 35, respectively. The pawls 60 are biased by the springs 18. Another spring 53 and a detent 54 are subsequently placed in the bore 52. The detent 54 is preferably a ball. The spring 53 is used to bias the detent 54 into a selective one of the recesses 47. Once the detent 54 is placed in the first or second recess 47, the upper ring 41 is rotatable together with the rotor 30.

Referring to FIGS. 2 and 7, a square axle 24 is placed in a square aperture axially defined in the rotor 30. A spring-biased detent 25 is placed on a lower section of the square axle 24 that is placed outside the rotor 30. The lower section of the square axle 24 can be inserted in a square cavity defined in a socket that in turn can be engaged with a nut or a head of a screw. The spring-biased detent 25 is used to keep the lower section of the axle 24 in the square cavity of the socket. The middle section 34 of the rotor 30 is placed in the head 21 while the upper section 32 and the lower section 33 are placed outside the head 21.

The upper ring 41 is placed on an upper edge of the head 21. The rib 43 is placed in the upper space 28 so that the upper ring 41 can smoothly be rotated on the head 21. The upper ring 41 is kept on the head 21 by a clip 23 that is placed in the groove 31 of the upper section 32 of the rotor 30.

A lower ring 26 is placed against a lower edge of the head 21. The lower ring 26 is kept in position by another clip 23 placed in the groove 31 of the lower section 33 of the rotor 30.

Referring to FIG. 7, the upper ring 41 is placed in a first angle relative to the rotor 30 as the spring 53 biases the detent 54 in the first recess 47. The first pawl 60 can be pivoted relative to the rotor 30. That is, the tip 66 can be moved out of the first cutout 35 while the pivot 65 is rotationally placed in the first cutout 35. The arched face 61 of the first pawl 60 is in contact with the arched face 37 of the first cutout 35. Now, the short thick portion 45 of the upper ring 41 keeps the second pawl 60 in the second cutout 35 and prevents the second pawl 60 from pivoting relative to the rotor 30.

When the head 21 is pivoted clockwise, one of the ratchets 51 is engaged with the tip 66 of the first pawl 60 so that the head 21 rotates the rotor 30. As the head 21 is pivoted counterclockwise, the ratchets 51 can be disengaged from the first pawl 60 so that the head 21 does not rotate the rotor 30. After the head 21 is pivoted counterclockwise for 10°, the head 21 can be pivoted clockwise again to engage a next one of the ratchets 51 with the tip 66 of the first pawl 60 so that the head 21 rotates the rotor 30.

Figure 8:
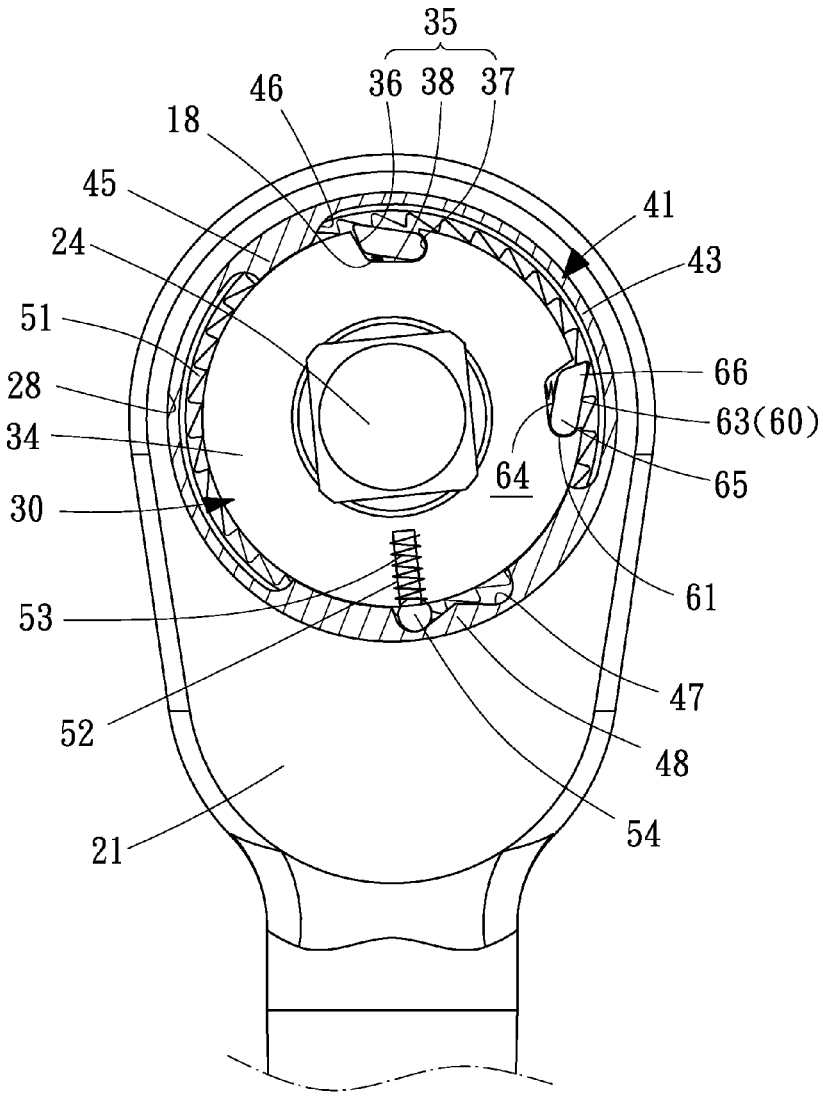
FIG. 8 is a cross-sectional view of the one-way torque tool in another position than shown in FIG. 7.

Referring to FIG. 8, the upper ring 41 is rotated to a second angle on the rotor 30 so that the spring 53 biases the detent 54 in the second recess 47. The short thick portion 45 of the upper ring 41 is moved away from the second pawl 60 to allow the second pawl 60 to pivot relative to the rotor 30. The first pawl 60 can still be pivoted relative to the rotor 30.

When the head 21 is pivoted clockwise, one of the ratchets 51 is engaged with the tip 66 of the first pawl 60 so that the head 21 rotates the rotor 30. As the head 21 is pivoted counterclockwise, the ratchets 51 can be disengaged from the first pawl 60 so that the head 21 does not rotate the rotor 30. After the head 21 is pivoted counterclockwise for 5°, the head 21 can be pivoted clockwise again to engage one of the ratchets 51 with the tip 66 of the second pawl 60 so that the head 21 rotates the rotor 30. Then, the head 21 is pivoted counterclockwise so that the head 21 does not rotate the rotor 30. After the head 21 is pivoted counterclockwise for another 5°, the head 21 can be pivoted clockwise again to engage one of the ratchets 51 with the tip 66 of the first pawl 60 so that the head 21 rotates the rotor 30.

Figure 9:
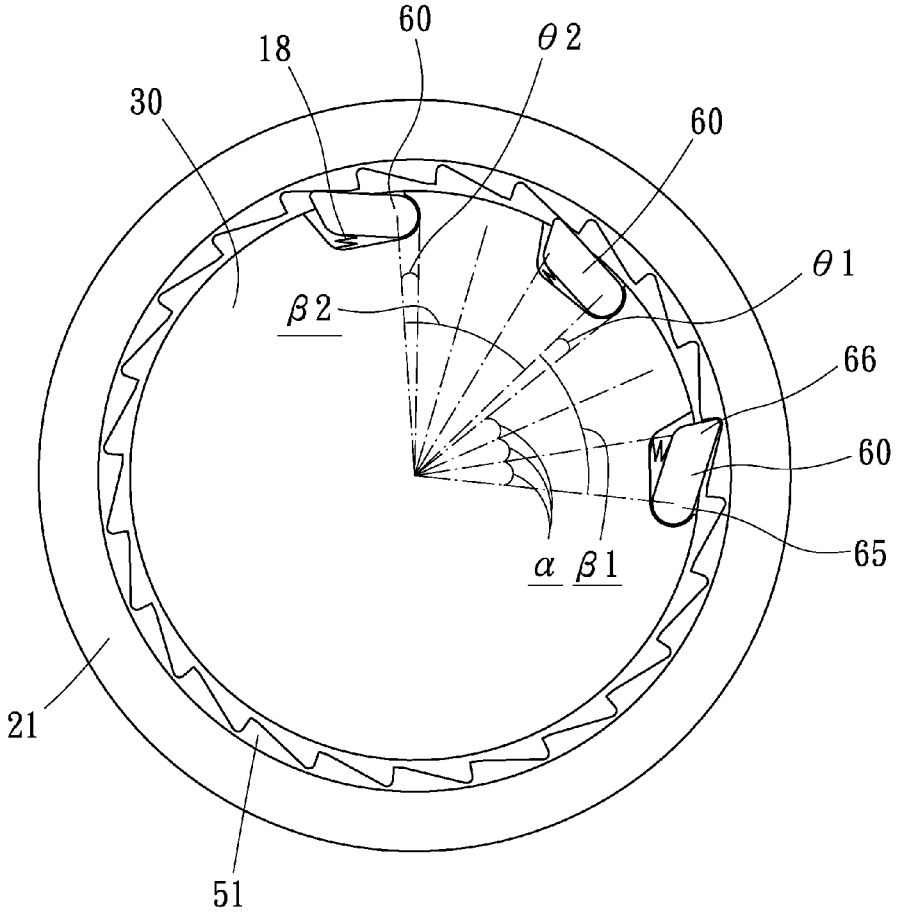
FIG. 9 is a top view of a one-way transmission according to the second embodiment of the present invention.

Referring to FIG. 9, there is shown a one-way transmission according to a second embodiment of the present invention. The second embodiment is like the first embodiment except including twenty-four ratchets 51 and three pawls 60. The angle $\alpha$ of each of the ratchets 51 is 15°. The first pawl 60 is separated from the second pawl 60 by an angle $\beta_1$ of 50° for example. The second pawl 60 is separated from the third pawl 60 by an angle $\beta_2$ of 50° for example. The angles $\beta_1$ and $\beta_2$ are derived from the angle of each of the ratchets 51 according to the following notions:

$$\beta_1 = n_1 \cdot \alpha + \theta_1 \quad (2)$$

$$\beta_2 = n_2 \cdot \alpha + \theta_2 \quad (3)$$

wherein $n_1$ and $n_2$ are 3, and $\theta_1$ and $\theta_2$ are 5°. It should however be noted that $n_1$ could be different from $n_2$, and $\theta_1$ could be different from $\theta_2$.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A one-way torque tool including:

a head;

a rotor placed in the head;

a number of ratchets formed on one of the head and the rotor, wherein the ratchets are separated from one another by a first angle $\alpha$ identical to degrees divided by the number of the ratchets;

two pawls pivotally connected to the other one of the head and the rotor and detachably engaged with the ratchets, wherein the pawls are separated from each other by a second angle $\beta$ identical to a multiple of the first angle $\alpha$ plus a third angle $\theta$ that is smaller than the first angle $\alpha$.

2. The one-way torque tool according to claim 1, wherein the ratchets are formed on an internal side of the head, wherein the first and second pawls are pivotally connected to an external side of the rotor.

3. The one-way torque tool according to claim 1, further including two springs for biasing the pawls.

4. The one-way torque tool according to claim 1, including another pawl separated from one of the pawls by a fourth angle $\beta$ identical to a multiple of the first angle $\alpha$ plus a fifth angle $\theta$ that is smaller than the first angle $\alpha$.

5. The one-way torque tool according to claim 4, wherein the fifth angle is identical to the third angle.

6. The one-way torque tool according to claim 4, wherein the fifth angle is different from the third angle.

7. The one-way torque tool according to claim 1, further including a switch operable for keeping one of the pawls from the ratchets.

8. The one-way torque tool according to claim 7, wherein the switch includes a ring switchable relative to one of the head and the rotor between a first position where the ring keeps one of the pawls from the ratchets and a second position where the ring does not keep any of the pawls from the ratchets.

9. The one-way torque tool according to claim 8, wherein the ring includes a rib placed in the head.

10. The one-way torque tool according to claim 9, wherein the rib includes a thick portion for pressing one of the pawls.

11. The one-way torque tool according to claim 9, wherein switch further includes a detent for abutment against the rib to keep the ring in one of the first and second positions relative to one of the head and the rotor.

12. The one-way torque tool according to claim 11, wherein the rib includes first and second recesses defined therein, wherein the detent is placed in the first recess when the ring in the first position relative to one of the head and the rotor, wherein the detent is placed in the second recess when the ring in the second position relative to one of the head and the rotor.

13. The one-way torque tool according to claim 11, wherein the switch further includes a spring for biasing the detent.

14. The one-way torque tool according to claim 13, wherein one of the head and the rotor includes a bore for containing the spring.

15. The one-way torque tool according to claim 1, wherein one of head and the rotor includes two cutouts each for containing at least a portion of a corresponding one of the pawls.

16. The one-way torque tool according to claim 15, wherein each of the pawls includes a pivot placed in the corresponding one of the pawls and a tip movable into engagement with the ratchets from the corresponding one of the pawls.

17. The one-way torque tool according to claim 16, wherein each of the cutouts includes an arched face, an inclined face and a flat face extending between the arched face and the inclined face, wherein each of the pawls includes an arched face formed near the pivot and in contact with the arched face of the corresponding one of the pawls.

18. The one-way torque tool according to claim 15, further including two springs for biasing the pawls.

19. The one-way torque tool according to claim 18, wherein one of head and the rotor includes two pockets for containing the springs.

20. The one-way torque tool according to claim 17, wherein each of the pawls includes a pivot placed in the corresponding one of the pawls and a tip movable into engagement with the ratchets from the corresponding one of the pawls.

* * * * *